US006479165B2

(12) United States Patent
Fischer et al.

(10) Patent No.: US 6,479,165 B2
(45) Date of Patent: Nov. 12, 2002

(54) ARC SPRAYING METHOD

(75) Inventors: Manfred Fischer, Leichingen (DE); Peter Godel, Freienried (DE); Werner Trubenbach, Obergriesbach (DE); Markus Müller, Burscheid (DE); Reinhard Rosert, Dresden (DE)

(73) Assignees: Federal-Mogul Friedberg GmbH (DE); Drahtwarenfabrik Drahtzug Stein GmbH & Co. KG (DE)

( * ) Notice: Subject to any disclaimer, the term of this patent is extended or adjusted under 35 U.S.C. 154(b) by 0 days.

(21) Appl. No.: 09/829,751

(22) Filed: Apr. 10, 2001

(65) Prior Publication Data

US 2001/0033942 A1 Oct. 25, 2001

(30) Foreign Application Priority Data

Apr. 20, 2000 (DE) ..... 100 19 794

(51) Int. Cl.[7] ..... B32B 15/02; B32B 15/20; C23C 30/00

(52) U.S. Cl. ..... 428/558; 428/937

(58) Field of Search ..... 428/558, 937

(56) References Cited

U.S. PATENT DOCUMENTS 5,022,455 A 6/1991 Takeda et al.
5,364,663 A * 11/1994 McCune, Jr. et al.
6,329,021 B1 * 12/2001 Haug et al.

FOREIGN PATENT DOCUMENTS

| | | |
|---|---|---|
| DE | 19841619 A1 | 3/2000 |
| GB | 2 273 109 A | 6/1994 |
| JP | 53-149 832 | 12/1978 |

* cited by examiner

*Primary Examiner*—John J. Zimmerman
*Assistant Examiner*—Jason L Savage
(74) *Attorney, Agent, or Firm*—Reising, Ethington, Barnes, Kisselle, Learman & McCulloch P.C.

(57) ABSTRACT

There is disclosed a material wire for wear-resistant and trobologically favorable shaped bodies manufactured by the arc spraying method, which comprises a covering (12) and a filling (14). The covering (12) comprises an alloy based on aluminium with at least one further alloy component, for example magnesium or manganese. The filling (14) comprises further alloy components for the resulting alloy of the shaped body, for example silicon. The filling (14) may apart from the silicon also comprise further components, for example aluminium and/or boron. By way of this the composition and the material properties of the resulting alloy of the shaped body may be set.

18 Claims, 1 Drawing Sheet

ARC SPRAYING METHOD

BACKGROUND OF THE INVENTION

The invention relates to a material wire for producing shaped bodies of wear-resistant and tribologically favorable aluminium/silicon alloys by way of the thermal spraying method.

Such alloys are known per se, in particular as surface coatings. They are used in particular as cylinder running surface of cylinder housings in reciprocating piston machines or combustion engines. Coatings of aluminium/silicon alloys are for example known from U.S. Pat. No. 50,22,455 A. In this, layers of melted aluminium and silicon particles are described which are sprayed separately onto the surface to be coated. Although such coatings may in a varied manner be deposited onto surfaces of substrates, in particular for this there are suitable thermal spraying methods for example plasma spraying or arc spraying. With plasma spraying, powder-like initial material melted in the flame is used, with arc spraying there is used a metallic initial material in the form of a material wire. The arc spraying method is with this particularly preferred since on account of the high cycle times it permits a high depositing rate of the coating, and is economical with regard to the material as well as the installation equipment.

From DE 43 41 537 there is known a composite wire for arc spraying as well as a method for its manufacture. The wire comprise a solid core of conductive metal and a covering in which solid lubricant particles and wear-resistant particles are homogeneously suspended in a conductive metal corresponding to the solid core. Such a composite wire is however in its manufacture relatively complicated and cost-intensive and not suitable for all applications.

In DE 198 41 619 A1 there is disclosed a material wire with a covering of metallic aluminium and a filling of a silicon alloy which serves the production of surface coatings of hypereutectic aluminium/silicon alloys. This material wire is simple and inexpensive to manufacture.

With thermal spraying methods a precise conveying capability of the used material wires is extremely important. This is because with the arc spraying method two wires must be led in a manner such that a stable common arc may arise and be maintained.

BRIEF SUMMARY OF THE INVENTION

It is therefore the object of the present invention to provide a material wire of the above-mentioned type which has a good and precise conveying capability as well as a uniform distribution of the alloy elements, and thus ensures the manufacture of wear-resistant and corrosion-resistant shaped bodies.

With the manufacture of the filler wire a tube of covering material is filled with filler material and subsequently subjected to drawing and/or rolling processes in order to reduce the diameter of the wire. By way of the addition of further alloy components to the aluminium in the material of the covering, its material properties may be changed and adapted to the demands.

Preferably magnesium is added to the aluminium alloy of the covering. This is because by way of this during the drawing or rolling processes on manufacture, the surface of the covering of the filler wire is strengthened. This effects a good and precise conveying ability of the material wire.

Preferably silicon is one component of the filling of the material wire so that the shaped body to be produced consists of an aluminium/silicon alloy. By way of the constituent portion of silicon in the filling the constituent portion of silicon in the shaped body to be produced may be set and controlled.

Preferably by way of a suitable addition of aluminium as one component of the filling the ratio of the constituent portions in the resulting alloy of the shaped body to be produced may be set and controlled.

The addition of boron as one component of the filling is preferred in order to improve the flowability of the shaped body to be produced.

Preferably the filling is composed such that the resulting constituent portion of the silicon in the alloy of the shaped body to be produced lies between about 12.5% by weight and about 50% by weight. Even more preferred the silicon constituent portion is about 15% by weight to about 40% by weight. Even more preferred is a silicon constituent portion between about 20% by weight and about 30% by weight. Most preferred however the constituent portion of silicon in the resulting alloy of the shaped body to be produced is about 25% by weight.

Preferably the material wire of the covering and filling is composed in a manner such that apart from aluminium and silicon farther constituent portions of the shaped body to be produced together are less than about 2% by weight.

Preferably the wire has a filling whose components as a statistical average have a grain size between 45 and 700 $\mu$m and particularly preferred between 300 and 600 $\mu$m. This embodiment in particular relates to fillings which contain silicon or essentially silicon or at least a silicon constituent portion.

Preferably the filling contains essentially silicon whilst the covering contains essentially aluminium, wherein the content of the silicon with respect to the total weight of the wire lies between 20 and 26, more preferred between 21 and 25 and most preferred between 22 and 24% by weight, wherein the rest i.w. is aluminium. In the formed spray layer of the shaped body to be produced the silicon content, on account of an enrichment by way of Al-burn-off is between 22 and 29, even more preferred between 24 and 28 and most preferred between 25 and 27% by weight.

Preferably the filling contains up to max. 1% by weight of boron, up to max. 10% by weight of Al and the rest silicon, whilst the covering has up to max. 1% by weight Si, max. 2% by weight Mg and max. up to 4% by weight Mn as well as the rest Al.

Preferably the material wire according to the invention is used with the arc spraying method. And here preferably for manufacturing cylinder liners of combustion engines.

DETAILED DESCRIPTION OF THE INVENTION

Figure 1:
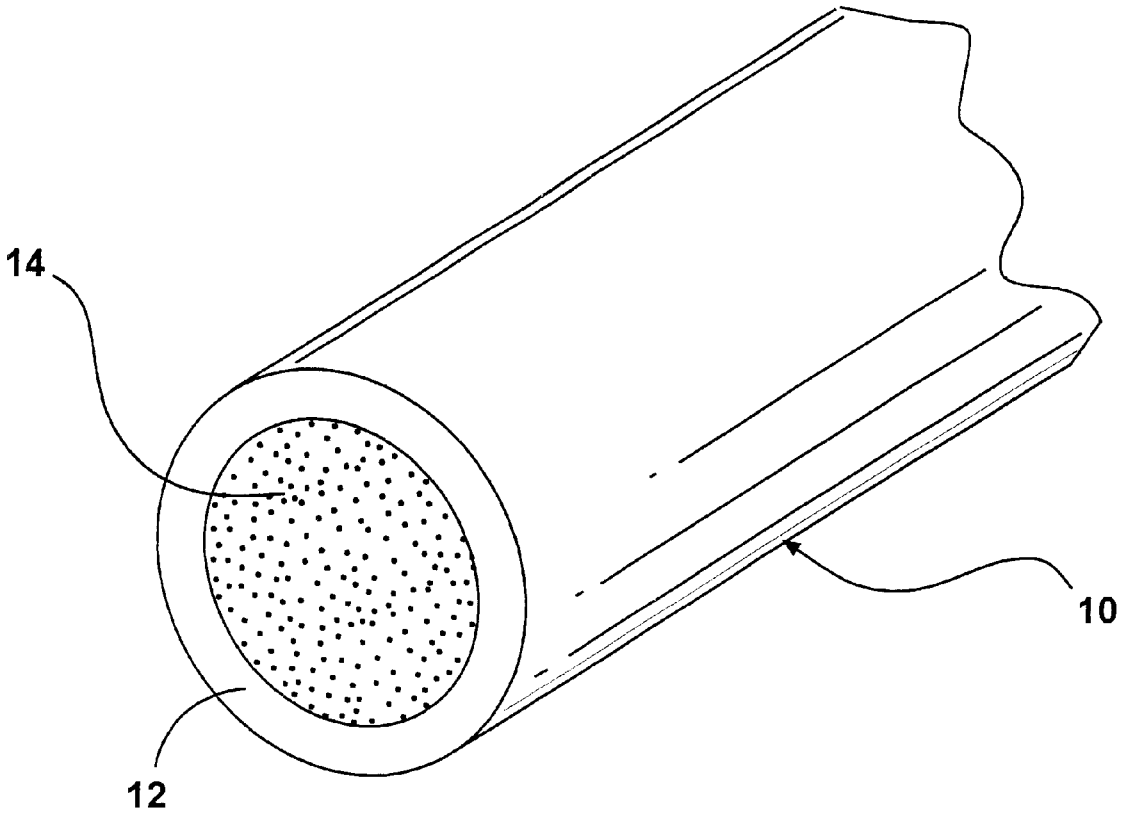
FIG. 1 is a fragmentary perspective view of a material wire constructed according to a presently preferred embodiment of the invention.

FIG. 1 shows a schematic sketch of a material wire 10 according to the invention which comprises a covering 12 and a filling 14. The covering 12 in this case comprises an alloy of aluminium with the alloy components silicon, magnesium, manganese. Enclosed by the covering 12 is the filling 14 which contains further powder-like components for a resulting alloy of a shaped body to be produced which with the material wire according to the invention may be deposited onto a substrate by way of an arc spraying method. The filling contains the alloy components silicon, boron and aluminium.

In the following by way of one embodiment example the invention and the manufacture of the material wire according to the invention is explained in detail. The manufacturing process envisages preparing a closed seamless tube as a covering 12. The covering 12 comprises an alloy based on aluminum with at least one further alloy component. In the embodiment example, to the aluminum there is added magnesium, silicon and manganese. The tube 12 may be drawn, welded or extruded. Subsequently the covering 12 is filled with a filling material 14. The components of the filling 14 are present as a coarse powder. In the embodiment example a powder quantity is used which comprises silicon, aluminum and boron. Even if a coarse powder is used the maximal grain size is about 600 $\mu$m. With respect to the total weight the silicon constituent portion of the wire (also the filling) is about 23% wherein the rest is aluminum. The filling 4 is compacted by way of a directed shaking during the filling. In the subsequent drawing procedure with which the material wire 10 is reduced to the final diameter, the powder of the filling is reduced in size, which leads to a compact filling and has a positive effect on the uniform distribution in the layer. For this reason on manufacture of the material wire according to the invention no organic or an organic binder may be applied which further has a positive effect on a low porosity in the layer. This represents a considerable improvement in comparison to surface coatings produced by plasma spraying since here only fine, agglomerated and thus expensive powders may be used. On account of the low porosity there is not the need to use fine silicon particles but the filling 14 may as previously explained have coarse powder particles.

The silicon constituent portion of the formed spray layer is on account of an Si-enrichment caused by Al-burn-off during the spray procedure between 25 and 27% by weight.

The diameter of the wire before drawing is about 10–11 mm, preferably about 10.4 mm, of which 6.4 mm is the filling and 4.0 mm the covering. After the drawing the wire has a diameter of 3.4 to 4 mm, of which about 2–3 mm is the filling.

The composition of the alloy of the spray layer or of the formed shaped body is max. 2% by weight B, max. 5% by weight Mn, max. 3% by weight Mg, between 14–50% by weight Si and between 60–85% by weight Al. The Mg-content may on account of the Al-burn off lie higher, the preferred Al-content lies at about 75%, the preferred Si-content at about 25%.

We claim:

1. A material wire for producing wear-resistant and tribologically favorable shaped bodies of aluminum/silicon alloys by way of thermal spraying, wherein the material wire is a filler wire which comprises a filling of silicon and further components, and a covering, wherein the constituent portion of the silicon in the filling is dimensioned such that the silicon constituent portion in the shaped body to be produced is about 12.5% by weight to about 50% by weight wherein the covering comprises an aluminum alloy which contains aluminum and at least one further alloy component, wherein the components of the filling comprise parts having a grain size between 45 and 700 $\mu$m and wherein the filling is free of organic or anorganic binders.

2. A material wire according to claim 1, wherein the further alloy component of the covering comprises magnesium.

3. A material wire according to claim 1, wherein the further alloy component of the covering comprises manganese.

4. A material wire according to claim 1, wherein one component of the filling contains aluminum.

5. A material wire according to claim 1, wherein one component of the filling contains boron.

6. A material wire according to claim 1, wherein the constituent portion of the silicon in the filling is dimensioned such that the silicon constituent portion in the shaped body to be produced is about 15% by weight to about 40% by weight.

7. A material wire according to claim 1, wherein the constituent portion of the silicon in the filling is dimensioned such that the silicon constituent portion in the shaped body to be produced is about 20% by weight to about 30% by weight.

8. A material wire according to claim 1, wherein the constituent portion of the silicon in the filling is dimensioned such that the silicon constituent portion in the shaped body to be produced is about 25% by weight.

9. A material wire according to claim 1, wherein the composition of the covering and of the filling is dimensioned such that apart from aluminum and silicon further constituent portions of the shaped body to be produced are less than about 2% by weight.

10. A material wire according to claim 1, wherein the components of the filling comprise parts having a grain size between 300 and 600 $\mu$m.

11. A material wire according to claim 1, wherein the filling comprises essentially silicon and the covering essentially aluminum, wherein with respect to the total mass the silicon content lies between 20 and 26% by weight, wherein the balance is essentially aluminum.

12. A material wire according to claim 11, wherein the silicon content of the formed shaped body or the formed spray layer lies between 22 and 29% by weight, wherein the balance is essentially aluminum.

13. The material wire according to claim 12 wherein the silicon content lies between 24 to 28% by weight.

14. The material wire according to claim 12 wherein the silicon content lies between 25 to 27% by weight.

15. The material wire according to claim 11 wherein the silicon content lies between 21 to 25% by weight.

16. The material wire according to claim 11 wherein the silicon content lies between 22 to 24% by weight.

17. A material wire according to claim 1, wherein the filling comprises max. 1% by weight boron and max. 10% by weight aluminum, wherein the balance is silicon.

18. A material wire according to claim 1, wherein the covering contains max. 1% by weight Si, max. 2% by weight Mg and max. 4% by weight Mn, wherein the balance is aluminum.

* * * * *